United States Patent [19]

Calvert

[11] Patent Number: 4,489,880

[45] Date of Patent: Dec. 25, 1984

[54] TAPERED CUP PACKAGE

[75] Inventor: Rodney K. Calvert, Dunwoody, Ga.

[73] Assignee: The Mead Corporation, Dayton, Ohio

[21] Appl. No.: 493,881

[22] Filed: May 12, 1983

[30] Foreign Application Priority Data

Jul. 20, 1982 [GB] United Kingdom ..... 8220907

[51] Int. Cl.[3] ..... B65D 5/02

[52] U.S. Cl. ..... 229/40; 229/27; 229/29 R; 229/15; 206/434; 206/486

[58] Field of Search ..... 229/40, 29 R, 41 R, 229/41 B, 27, 15, 39 B, 10; 206/426, 427, 434, 429, 486

[56] References Cited

U.S. PATENT DOCUMENTS

| | | | |
|---|---|---|---|
| 3,010,573 | 11/1961 | Chidsey, Jr. | 229/40 |
| 3,049,282 | 8/1962 | Chidsey, Jr. et al. | 229/40 |
| 3,123,214 | 3/1964 | McReynolds, Jr. | 229/40 |
| 3,157,309 | 11/1964 | Chidsey, Jr. et al. | 229/40 |
| 3,399,821 | 9/1968 | Ringholz | 229/40 |
| 3,791,571 | 2/1974 | Pilz | 229/40 |
| 4,131,198 | 12/1978 | Fischer | 206/419 |
| 4,164,286 | 8/1979 | Sutherland | 206/434 |
| 4,213,598 | 7/1980 | Halasz | 229/40 |
| 4,214,696 | 7/1980 | Barton et al. | 229/40 |
| 4,448,308 | 5/1984 | Carver | 229/40 |

*Primary Examiner*—Joseph Man-Fu Moy
*Attorney, Agent, or Firm*—Erwin Doerr

[57] ABSTRACT

A package (10) of the wrap-around type including a wrapper (12) formed from paperboard or similar foldable sheet material and accommodating containers arranged in two parallel rows, which package comprises a keel construction (32) providing support for each container and separating one row of containers from the other row, said keel construction being released by cuts from a base panel (14) of the wrapper and including a separator platform (34) held substantially parallel to said base panel by a plurality of support legs (36–42; 60–64) each of which is hinged to the base panel and to one side of the separator platform.

7 Claims, 3 Drawing Figures

12
14
16
18
20
22
24
26
28
30
32
34
36
40
42
44
46
48
50
52
54
56
58
60
62
64
66
68
70
72
74
76
82
84
86
88
90
92
94
96
98
100
102
104
106
108
110
112
S'

12a
14a
16a
18a
20a
22a
24a
26a
28a
30a
32a
34a
36a
40a
42a
44a
46a
48a
50a
52a
54a
56a
58a
60a
62a
64a
66a
68a
70a
72a
74a
76a
82a
84a
86a
88a
90a
92a
94a
96a
98a
100a
102a
104a
106a
108a

TAPERED CUP PACKAGE

This invention relates to the packaging of a group of articles having the form of cups with tapered sidewalls which are arranged in double row relation and enclosed in a wrap-around type blank of foldable sheet material.

The package includes a central keel construction which separates one row of cups from the other row and which also provides support for body portions of the cups. Packages of this general type are known, for instance, from Registered Design application No. 1,003,502 and from U.S. Pat. Nos. 4,164,286 and 3,352,453. In those constructions, the central keel construction is formed from material which is an extension of a base panel of the wrapper blank which is folded back and glued to the base panel. This type of construction requires both extra material and a glueing operation to form the keel. The present invention reduces the amount of material required in order to form the keel and also eliminates the necessity of a glueing operation.

The invention provides a package of the wrap-around type including a wrapper formed from paperboard or similar foldable sheet material and accommodating containers arranged in two parallel rows, which package comprises a keel construction providing support for each container and separating one row of containers from the other row, said keel construction being released by cuts from a base panel of the wrapper and including a separator platform held substantially parallel to said base panel by a plurality of support legs each of which is hinged to the base panel and to one side of the separator platform.

Figure 1:
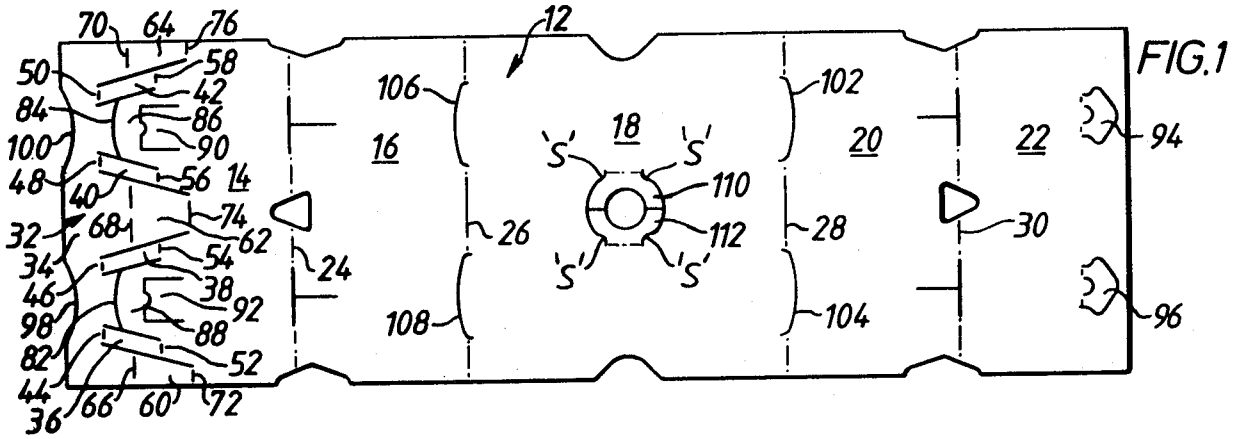
Figure 2:
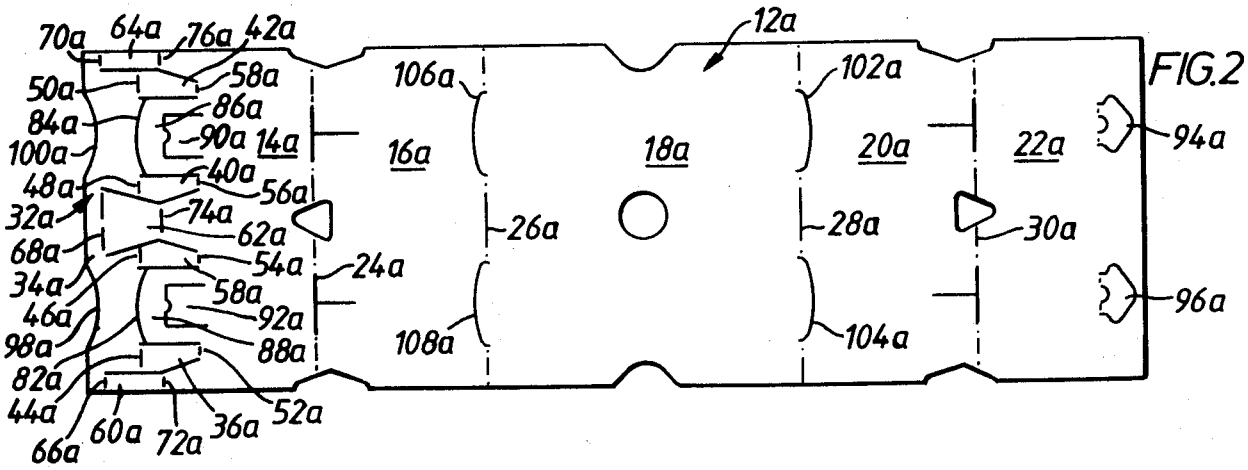
Figure 3:
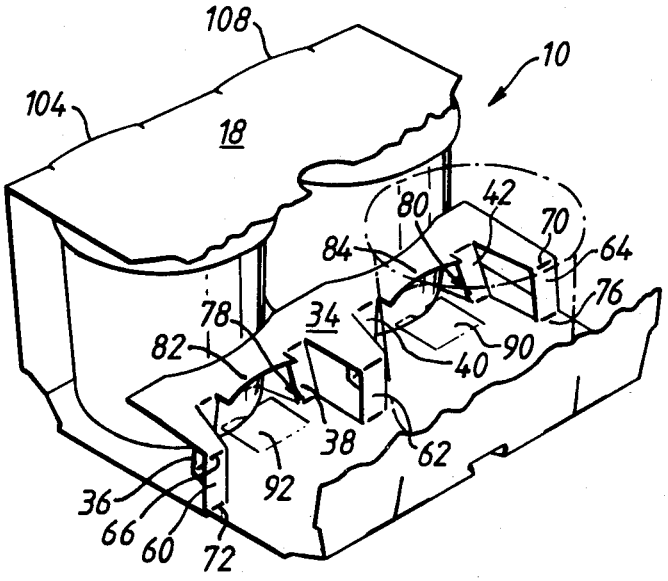

Two embodiments of the invention will now be described, by way of example, with reference to the accompanying drawings, in which:

FIG. 1 is a plan view of a blank for forming a package according to the invention, FIG. 2 is a plan view of a blank for forming a modified package according to the invention, similar to that shown in FIG. 1, and FIG. 3 is a perspective view of a package formed from the blank shown in FIG. 1 and which is shown partially broken away to expose the keel construction.

Referring first to FIGS. 1 and 3 of the drawings, there is shown a package 10 formed from an elongate blank 12 of paperboard or similar foldable sheet material. The blank 12 is suitable for forming a package of two rows of tapered cups having two cups in each row.

The blank 12 comprises a first base panel 14, a first side wall panel 16, a top panel 18, a second side wall panel 20 and a second base panel 22 hinged one to the next along transverse fold lines 24, 26, 28 and 30 respectively.

Base panel 14 has struck therefrom a keel construction generally designated numeral 32 adapted to retain the packaged cups within the package and to separate one row of cups from the other row. The keel construction comprises a separator platform 34 and two spaced sets of support legs to which the platform integrally is hinged. One set of supports comprises four legs 36, 38, 40 and 42 hinged to the separator platform along short fold lines 44, 46 and 48 and 50 respectively and to the base panel 14 along short fold lines 52, 54, 56 and 58 respectively. The other set of supports is spaced apart from the first set in a direction towards fold line 24.

This set comprises three legs 60, 62 and 64 hinged to the separator platform along short fold lines 66, 68 and 70, respectively and to the base panel 14 along short fold lines 72, 74, 76, respectively. For use, the separator platform is raised from its flat condition shown in FIG. 1 into an erected condition in which it lies substantially parallel to the base panel 14. To achieve this, both sets of support legs are hinged about their respective fold lines and brought into an upstanding position substantially perpendicular to the base panel 14. When the separator platform is thus erected, a pair of recesses 78, 80 are defined by the upstanding support legs. Recess 78 is provided between support legs 64 and 62 and has a depth equivalent to the spacing between support legs 64, 62 and support legs 40 and 42. Similarly, recess 80 is provided between support legs 60 and 62 and has a depth equivalent to the spacing between support legs 60, 62 and support legs 36 and 38. Arcuate abutments 82, 84 integral with the separator platform and located between support legs 40, 42 and 36, 38 respectively, extend into the recesses 78, 80 respectively, each to provide support for the body portion of a cup in one of the rows.

The arcuate abutment 84 and support legs 40, 42 are struck from the blank so as to form a tab 86 when the separator platform is erected, and similarly tab 88 is formed when arcuate abutment 82 and support legs 36, 38 are struck from the blank. Tabs 86 and 88 are provided with retaining tabs 90, 92 respectively which defining locking apertures into which locking tabs 94, 96, formed in base panel 22, are punched to lock the base panels together in overlapping relationship.

Further arcuate abutments 98, 100 are formed at the free edge of separator platform 34 each to provide support for the body portion of a cup in the second row.

As best seen in FIG. 3 the blank is applied to a group of four cups arranged in two rows so that the cups in one row stand on base panel 22, have their body portions supported and retained by the arcuate abutments 98, 100, respectively, and have peripheral portions of their top flanges inserted into elongate slots 102, 104, struck out along fold line 28. Similarly, the cups in the other row stand on base panel 14, have their body portions supported and retained against abutments 82, 84 within recesses 78, 80 respectively, and have peripheral edge portions of their top flanges inserted into elongate slots 106, 108 struck out along fold line 26.

For additional retention, the top panel 18 includes hinged flaps 110, 112 respectively, which may be swung downwardly so that the shoulder portions 's' of each flap engages beneath the peripheral flange of neighbouring cups in adjacent rows.

The blank shown in FIG. 2 is of similar construction to that of FIG. 1 and, where appropriate, like reference numerals designate like parts with the addition of suffix 'a'. However, in this embodiment the arrangement of the legs supporting the separator platform has been altered.

I claim:

1. A package of the wrap-around type including a wrapper formed from paperboard or similar foldable sheet material and accommodating containers arranged in two parallel rows, which package comprises a top wall, opposing side walls and base panels joined to said side walls along fold lines remote from said top wall, a keel construction foldably joined to one of said base panels and providing support for each container and separating one row of containers from the other row, said keel construction being released by cuts from said one base panel and including a separator platform held substantially parallel to said one base panel by a plurality of support legs each of which is hinged to said one base panel and to one side of the separator platform.

2. A package according to claim 1, wherein two sets of support legs are provided, one set being hinged to the separator platform at spaced locations at said one side thereof, and the other set being hinged to the separator platform at spaced locations and spaced apart from said first set in a direction towards the fold line between said one base panel and the associated side wall.

3. A package according to claim 2, wherein said other set of support legs comprises a central leg and one leg at each end of the separator platform.

4. A package according to claim 3, wherein a recess which receives and retains a body portion of a cup is provided on either side of the central support leg, said recess in each case being defined by both sets of support legs and wherein the depth of each recess is equivalent to the spacing between the respective sets of support legs.

5. A package according to claim 4 in which an abutment surface engaging a body part of a cup extends from said edge of the separator platform in each of said recesses.

6. A package according to claim 5 in which the opposite side of the separator platform includes an arcuate abutment surface for the body portion of a different cup, said surface being formed by a recessed edge of the separator platform.

7. A package according to claim 2, wherein said one set of support legs comprises a central leg and one leg at each end of the separator platform.

* * * * *